US006220684B1

(12) United States Patent
Bent et al.

(10) Patent No.: US 6,220,684 B1
(45) Date of Patent: Apr. 24, 2001

(54) ADJUSTABLE RETAINER ASSEMBLY FOR A REFRIGERATOR DOOR SHELF

(75) Inventors: Francis Eugene Bent, Oneida; John C. Ellingwood, Galesburg, both of IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/615,786

(22) Filed: Jul. 13, 2000

(51) Int. Cl.[7] ..... A47B 96/04

(52) U.S. Cl. ..... 312/405.1; 312/401; 312/321.5; 211/88.01

(58) Field of Search ..... 312/401, 405, 312/405.1, 408, 321.5, 116; 211/88.01, 184, 90.01; 62/377

(56) References Cited

U.S. PATENT DOCUMENTS

| | | | | |
|---|---|---|---|---|
| 2,412,904 | | 12/1946 | Money et al. . | |
| 3,220,558 | * | 11/1965 | Olsson | 312/405.1 X |
| 3,625,371 | | 12/1971 | Dill . | |
| 3,893,739 | | 7/1975 | Bernard | 312/321.5 |
| 4,023,682 | | 5/1977 | Niece | 211/184 |
| 4,437,572 | | 3/1984 | Hoffman . | |
| 4,560,072 | * | 12/1985 | Burrell | 211/88.01 X |
| 4,867,318 | | 9/1989 | Robson | 211/184 X |
| 5,038,689 | | 8/1991 | Duffy . | |
| 5,119,948 | | 6/1992 | Hallgrimsson . | |
| 5,567,029 | | 10/1996 | Haenisch et al. | 312/405.1 |
| 5,685,624 | * | 11/1997 | Lee | 312/405.1 |
| 6,039,424 | * | 3/2000 | Pink | 312/405.1 |

FOREIGN PATENT DOCUMENTS

| | | | | |
|---|---|---|---|---|
| 569511 | | 8/1958 | (BE) . | |
| 1132567 | | 7/1962 | (DE) . | |
| 1381650 | * | 1/1975 | (GB) | 312/321.5 |
| 590977 | | 4/1959 | (IT) | 312/321.5 |

* cited by examiner

*Primary Examiner*—James O. Hansen
(74) *Attorney, Agent, or Firm*—Diederiks & Whitelaw PLC

(57) ABSTRACT

A retainer assembly for preventing food containers placed on a shelf of a refrigerator door from falling off the shelf when the refrigerator door is abruptly opened or closed includes a retaining element which is connected to a crosspiece extending above a base of the shelf and pivotally movable relative to the crosspiece between first and second extreme positions, as well as a substantially infinite number of intermediate positions. The retaining element is either directly attached to the crosspiece or pivotally connected to a supporting sheath that is snap-fit onto the crosspiece. In either case, the retaining element rides along one or more camming surfaces which causes the retaining element to be physically deformed as it is pivoted between the first and second extreme positions.

24 Claims, 5 Drawing Sheets

FIG. 5
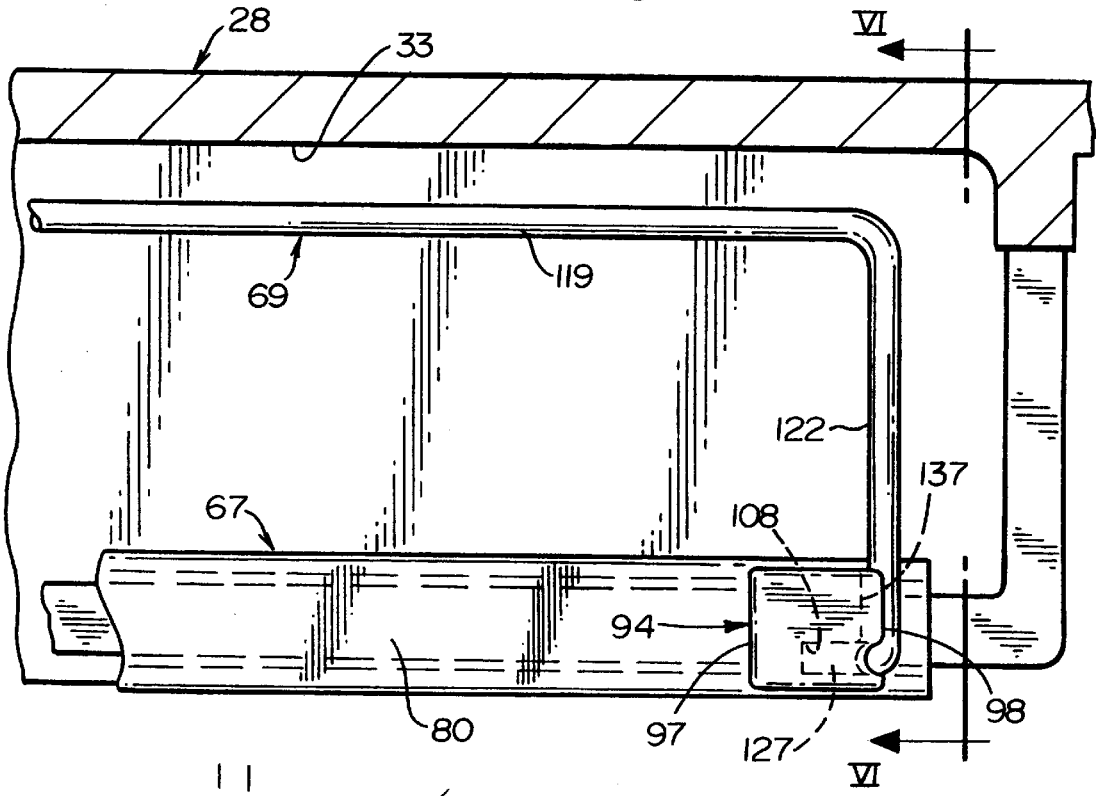
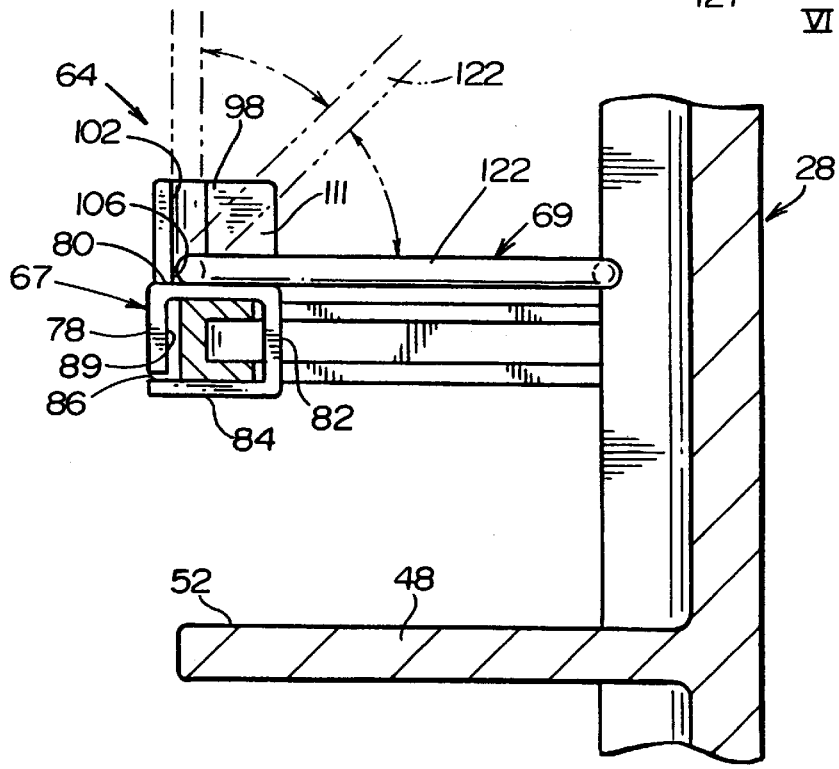
FIG. 6

ADJUSTABLE RETAINER ASSEMBLY FOR A REFRIGERATOR DOOR SHELF

BACKGROUND OF THE INVENTION

1. Field of the Invention

The present invention pertains to the art of refrigerators and, more particularly, to an adjustable retainer assembly for maintaining food containers in a desired storage condition upon a shelf provided on an interior portion of a refrigerator door.

2. Discussion of the Prior Art

It is well known in the art to form refrigerator doors with inner liners which incorporate a plurality of shelves upon which various food containers may be stored. These shelves are often designed to hold narrow containers, such as wine bottles or salad dressings. Most often, a refrigerator door shelf will be provided with an associated front wall or a cross bar such that, when the refrigerator door is abruptly opened, the front wall of the shelf will serve as a retainer and prevent any forward motion of the food container. Thus, the front wall would prevent undesirable movement of the container upon the shelf, thereby hindering any tipping over of the food container.

Recently, refrigerator shelves have been made much deeper than in the past in order to acconmmodate much wider and taller containers, such as large mayonnaise jars or one gallon milk jugs. In a manner similar to prior known arrangements, the shelf has an associated front wall or cross bar which prevents fore-to-aft movement of the containers in order to prevent the containers from falling off the shelf when the refrigerator door is opened. However, when a rather tall and narrow food container is placed on the same shelf, the front wall of the shelf cannot prevent a substantial amount of fore-to-aft movement of the container. Thus, such containers will be prone to toppling over, spilling and perhaps even breaking when the refrigerator door is abruptly opened.

In an attempt to solve this known problem, it is heretofore been proposed to attach additional retaining structure to the refrigerator door liner itself. Such retaining structures, typically taking the form of retaining bars, are used to effectively change the depth of the shelf by applying pressure to an upper portion of the food container, thus holding the container in place when the refrigerator door is opened. U.S. Pat. No. 5,567,029 discloses various retainer arrangements, each including a removable retainer element mounted to the inner liner of a refrigerator door and capable of being pivoted to adapt modern deep refrigerator door shelves for use with varying food container sizes. More specifically, in accordance with this patented arrangement, a retainer bar can be pivoted to various discreet positions relative to the liner, while being maintained in a desired position by cooperating with detent structure. Although this known prior art solves numerous problems encountered with deep refrigerator shelves, the adjustable retainer assembly still has certain drawbacks. Primarily, the number of positions in which the bar can be retained is preset and therefore limited.

Based on the above, it would be desirable to have an adjustable retainer assembly which can be set in a substantially infinite number of positions such that it could be adjusted to a selected position dedicated to the specific size of the food container supported on the shelf. In addition, it is desirable to provide an adjustable retainer assembly which can be selectively incorporated into new refrigerators or readily retrofitted onto existing refrigerator door shelving arrangements.

SUMMARY OF THE INVENTION

The present invention is directed to an adjustable retainer assembly for a refrigerator door shelf designed to prevent unwanted movement of food containers placed on the shelf so as to assure that the food containers will not topple over, even when the refrigerator door is abruptly opened. More particularly, the invention is directed to providing an adjustable retainer assembly that can be readily shifted between various, non-discreet positions so as to be substantially, infinitely adjustable in order to accommodate a full range of different containers on the shelf.

In accordance with most preferred embodiment of the invention, the adjustable retainer is constituted by an elongated, inverted U-shaped retaining element, such as a rod or bar, defined by a substantially straight central section and bent end sections. Each of the bent sections includes a in-turned terminal end for pivotally mounting the retaining element. In the most preferred embodiment of the invention, the retaining element is pivotally connected to a pair of support elements carried by a mounting sheath. More specifically, the terminal ends are pivotally mounted to the support elements, with the support elements having camming surfaces which are abutted by the bent sections of the retaining element. The bent sections are biased inward against the camming surfaces such that, as the retaining element is pivoted relative to the mounting sheath, the bent sections are forced slightly inward or outward, i.e., toward or away from each other. This deformation of the retaining element provides the necessary force to maintain the element in any one of a substantially infinite number of positions along the camming surface.

Most preferably, the retaining element can be maintained in an infinite number of positions between first and second extreme positions. In one extreme position, the retaining element extends substantially vertically above the shelf and, in the second extreme position, the retaining element is rotated towards a horizontal position. The mounting sheath is designed to be snap-fittingly attached to a cross piece that extends laterally across a front portion of a refrigerator door shelf, thereby enabling the adjustable retainer assembly to be easily incorporated into newly produced refrigerators or retrofitted into existing units. Furthermore, the entire retainer assembly can be detached from the refrigerator door if desired.

Additional objects, features and advantages of the adjustable retainer assembly of the present invention will become more readily apparent from the following detailed description of preferred embodiments thereof when taken in conjunction with the drawings wherein like reference numerals refer to corresponding parts in the several views.

BRIEF DESCRIPTION OF THE DRAWINGS

FIG. 5 is a top view of a portion of the adjustable retainer assembly in the second extreme position;

FIG. 6 is a cross-sectional view generally taken a long line VI—VI in FIG. 5;

DETAILED DESCRIPTION OF THE PREFERRED EMBODIMENTS

Figure 1:
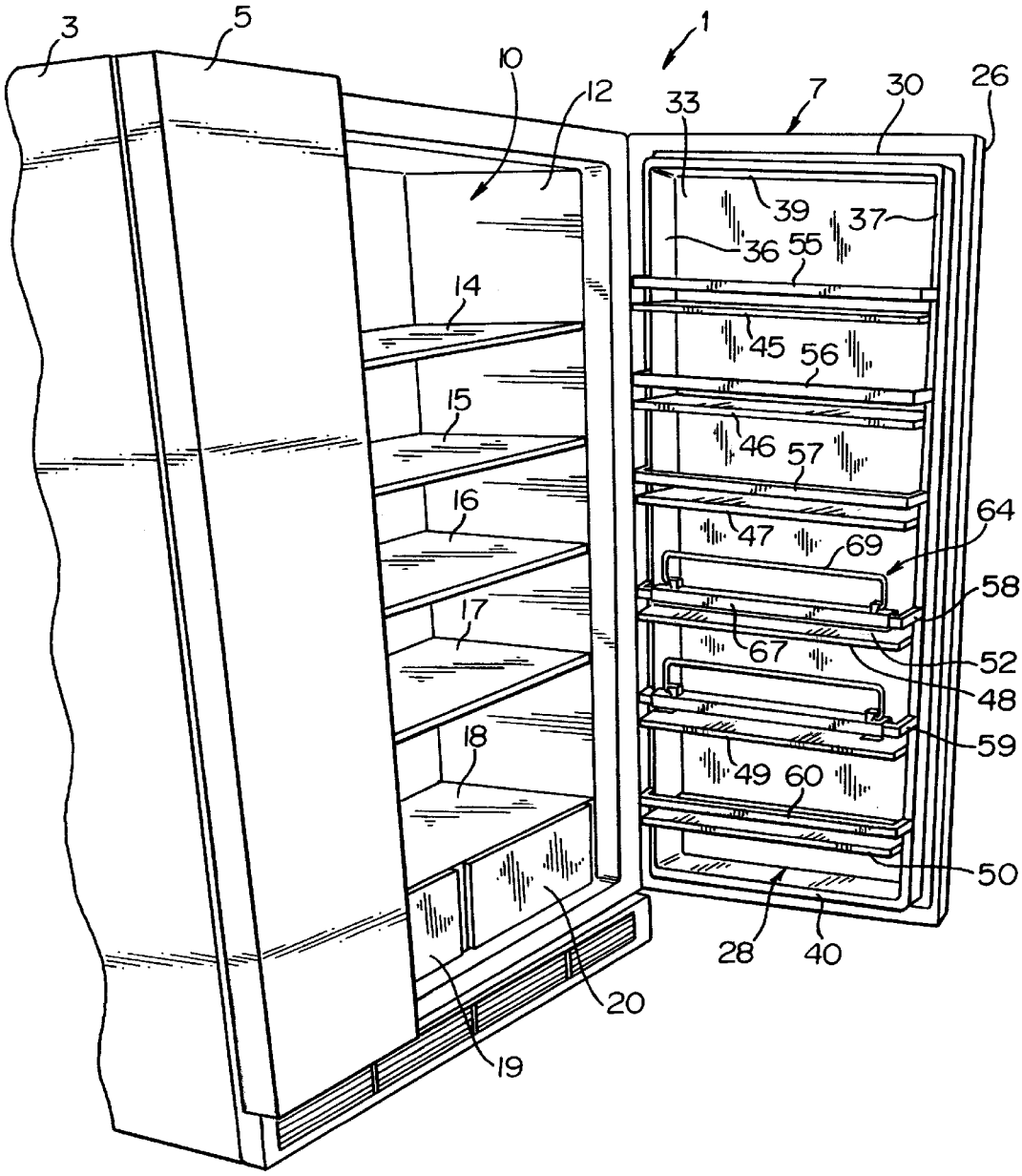
FIG. 1 is a perspective view of a side-by-side refrigerator having an open fresh food compartment door including multiple shelves and an adjustable retainer assembly constructed in accordance with a first embodiment of the invention.

FIG. 1 illustrates a portion of a refrigerator 1 including a cabinet shell 3. Pivotally mounted to cabinet shell 3 is a freezer door 5 and a fresh food door 7. Fresh food door 7 is shown open so as to expose a fresh food compartment 10 defined by a liner 12. Shown provided within fresh food compartment 10 is a plurality of vertically spaced, generic shelves 14–18, as well as a pair of spaced, lower slidable bins 19 and 20.

In the embodiment shown, refrigerator 1 represents a side-by-side refrigerator. However, as will become more readily apparent below, the invention is equally applicable to various types of refrigerator arrangements, including top-mount refrigerator models. In any event, as further shown, fresh food compartment door 7 includes an outer panel 26 to which is attached an inner liner 28. Extending about inner liner 28 is an annular gasket 30 for use in sealing fresh food compartment door 7 against cabinet shell 3. Inner liner 28 includes a rear upstanding wall portion 33 from which project a pair of laterally spaced dike portions 36 and 37, an upper dike portion 39 and a lower dike portion 40. In accordance with a preferred embodiment of the invention, liner 28 is thermoformed in a manner known in the art. Extending across dike portions 36 and 37 are shown a plurality of vertically spaced shelves 45–50. Each shelf 45–50 includes a respective base 52. Above each base 52, each shelf 45–50 is shown to include a respective crosspiece 55–60 which also extends between dike portions 36 and 37.

At this point, it should be realized that the basic configuration of refrigerator 1 is known in the art and that generic structure is shown in this figure and described above for the sake of simplicity, while enabling a full understanding of the present invention. As would be readily recognized to one of ordinary skill in the art, shelves 45–50 can also be thermoformed so as to be integral with liner 28 or separately formed as either a planer shelf, bin or basket which could be supported by liner 28 in a manner also widely known in the art. Furthermore, although crosspieces 55–60 are shown to be separate and spaced from shelves 45–50, it should be recognized that one or more of crosspieces 55–60 could be integrally formed with the respective shelf 45–50, such as being defined by a front wall portion of a pick-off bin. In any case, it is only important to note that crosspieces 55–60 extend across dike portions 36 and 37 at a position spaced above base 52 of a respective shelf 45–50 and finction to aid in maintaining containers or the like supported upon base 52 when fresh food compartment door 7 is opened or closed.

In accordance with the present invention, a retainer assembly, generally indicated at 64 in FIG. 1, is provided to further aid in preventing food containers supported upon base 52 of a respective shelf 45–50 from tipping over when fresh food compartment door 7 is moved such that retainer assembly 64 supplements the function of a respective crosspiece 55–60, while also adding versatility to the overall structure and function. As will be described in detail below with respect to each of the preferred embodiments of the invention, retainer assembly 64 can be adjusted to a substantially infinite number of positions between two extreme positions. In the most preferred embodiments of the invention, retainer assembly 64 is generally defined by a mounting sheath 67 to which is pivotally mounted a retaining element 69.

As clearly shown with reference to FIGS. 2–6, mounting sheath 67 of the retainer assembly 64 constructed in accordance with the first embodiment of the invention is defined by an elongated front leg 78, a top leg 80, an aft leg 82 and a lower leg 84. Preferably, leg 78, 80, 82 and 84 are integrally molded. In any event, the front leg 78 is preferably spaced from aft leg 82 by a distance defined by top leg 80, with this distance being slightly greater than the fore-to-aft dimension of a respective crosspiece 55–60. Mounting sheath 67 also defines an elongated opening 86 located below front leg 78. More specifically, aft leg 82 extends vertically a distance greater than front leg 78 and lower leg 84 is substantially parallel to top leg 80 such that front leg 78 is spaced from lower leg 84 by elongated opening 86. Due to the presence of elongated opening 86, the inherent flexibility of leg 78, 80, 82 and 84 and the fact that the lateral ends of mounting sheath 67 are open such as indicated at 89 in FIG. 6, mounting sheath 67 can be generally snap-fit onto a respective crosspiece 55–60. That is, legs 78, 80, 82 and 84 can be flexed apart to enable mounting sheath 67 to receive a respective crosspiece 55–60, with legs 78, 80, 82 and 84 being also elastic in nature such that they snap back and essentially clamp down onto the respective crosspiece 55–60 as generally shown in FIG. 6. Obviously, sheath 67 must be somewhat larger than the respective crosspiece 55–60 to permit the mounting of sheath 67. Therefore, in the preferred embodiment, top leg 80 and lower leg 84 actually bear directly on the crosspiece 55–60.

Provided on top leg 80 of mounting sheath 67 is a pair of spaced support elements or blocks 94 and 95. In essence, support elements 94 and 95 are mirror images of one another such that the structure of support element 94 will now be detailed and it is to be understood that support element 95 is similarly constructed. As shown in these figures, support element 94 includes an inner lateral surface portion 97 and an outer lateral surface portion 98. Outer lateral surface portion 98 includes a frontal, upright groove 102 having an open upper end 104 and a lower end 106. Lower end 106 leads to a lateral bore 108 extending within support element 94. Adjacent upright groove 102 along outer lateral surface 98 is defined a camming surface 111. Camming surface 111 preferably tapers downwardly towards top leg 80 of mounting sheath 67. The particular purpose of this camming surface 111 will become more fully apparent below.

As indicated above, retainer assembly 64 also includes retaining element 69 that preferably takes the form of an inverted, generally U-shaped bar. In any event, retaining element 69 includes a central portion 119 which leads to opposing bent end sections 122 and 123. Bent sections 122 and 123 are provided with in-turned terminal ends 127 and 128 respectively. As shown, each in-turned terminal end 127, 128 is received within a respective lateral bore 108 of support blocks 94 and 95. In positioning retaining element 69 in this manner, retaining element 69 will be permitted to pivot about an axis defined by in-turned terminal ends 127 and 128. Upon mounting retaining element 69, bent sections 122 and 123 are preferably deflected outwardly such that there is an inherent biasing force within retaining element 69 tending to draw bent sections 122 and 123 toward one another.

Figure 2:
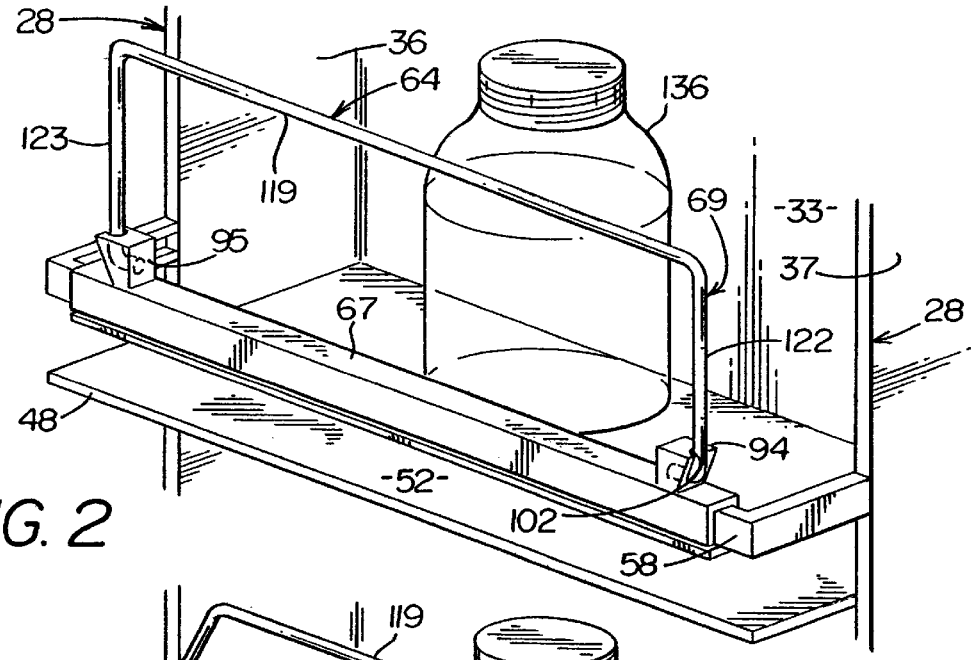
FIG. 2 is an enlarged perspective view of the adjustable retainer assembly of FIG. 1, with the retainer assembly shown in an upright, first
Figure 3:
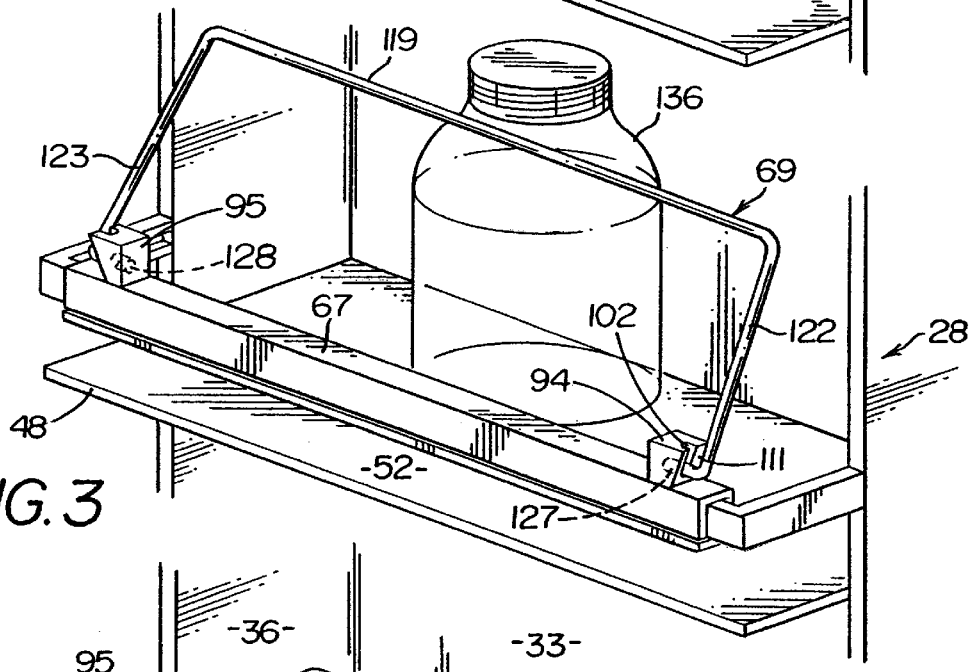
FIG. 3 is an enlarged perspective view of the adjustable retainer assembly in an intermediate position.

FIG. 2 shows retaining element 69 mounted in the manner set forth above to mounting sheath 67, as well as mounting sheath 67 being attached to an exemplary crosspiece 58. Here, retaining element 69 is shown to be arranged in a first extreme position wherein retaining element 69 extends in a substantially vertical plane above crosspiece 58. In this position, a lower portion of each bent section 122, 123 is arranged within a respective upright groove 102 to firmly maintain retaining element 69 in position substantially directly above crosspiece 58. Retaining element 69 can pivot from this first extreme position toward upstanding wall portion 33 of liner 12 as shown in FIG. 3. When shifting retainer element 116 from the position shown in FIG. 2 to the position shown in FIG. 3, bent sections 122 and 123 are forced out of the respective upright grooves 102 and engage camming surfaces 111. In shifting to camming surfaces 111, bent sections 122 and 123 are physically deformed and an inherent force is created which tends to further bias bent sections 122 and 123 toward one another. In any event, in this position, it can be seen that central portion 119 of retaining element 69 can substantially abut a container 136 supported upon base 52 of shelf 45. The exact positioning of retaining element 69 can be customized to accommodate the particular configuration of container 136. That is, it is preferable to have camming surfaces 111 constitute smooth, downward tapering surfaces which will enable a substantially infinite number of positions to be established for retaining element 69. In addition to acting as an extension of crosspiece 58, the versatility of adjustment of retaining element 69 is considered to be an important advantageous feature of the invention.

Figure 4:
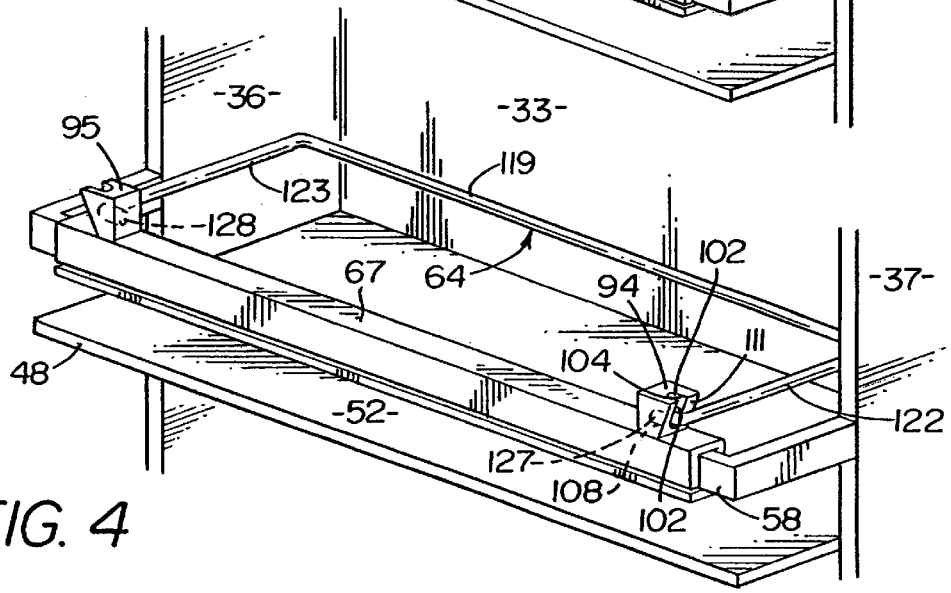
FIG. 4 is an enlarged perspective view of the adjustable retainer assembly in a second extreme position.

As retaining element 69 continues to be rotated, retaining element 69 can assume the position shown in FIG. 4 wherein retaining element 69 is preferably in a substantially horizontal plane. In accordance with this preferred embodiment of the invention, each support element 94, 95 is also formed with a respective horizontal groove 137 (see FIG. 5) into which a portion of a respective bent section 122, 123 is received when retaining element 69 reaches the position shown in FIG. 4. When in this position, central portion 119 of retaining element 69 is slightly spaced from upstanding wall portion 33 as clearly shown in FIG. 5. Of course, the actual spacing from upstanding wall portion 33 will merely depend on the spacing of crosspieces 55–60 from upstanding wall portion 33, as well as the length of bent sections 122 and 123, both of which could be readily varied without departing from the spirit of the invention.

Figure 7:
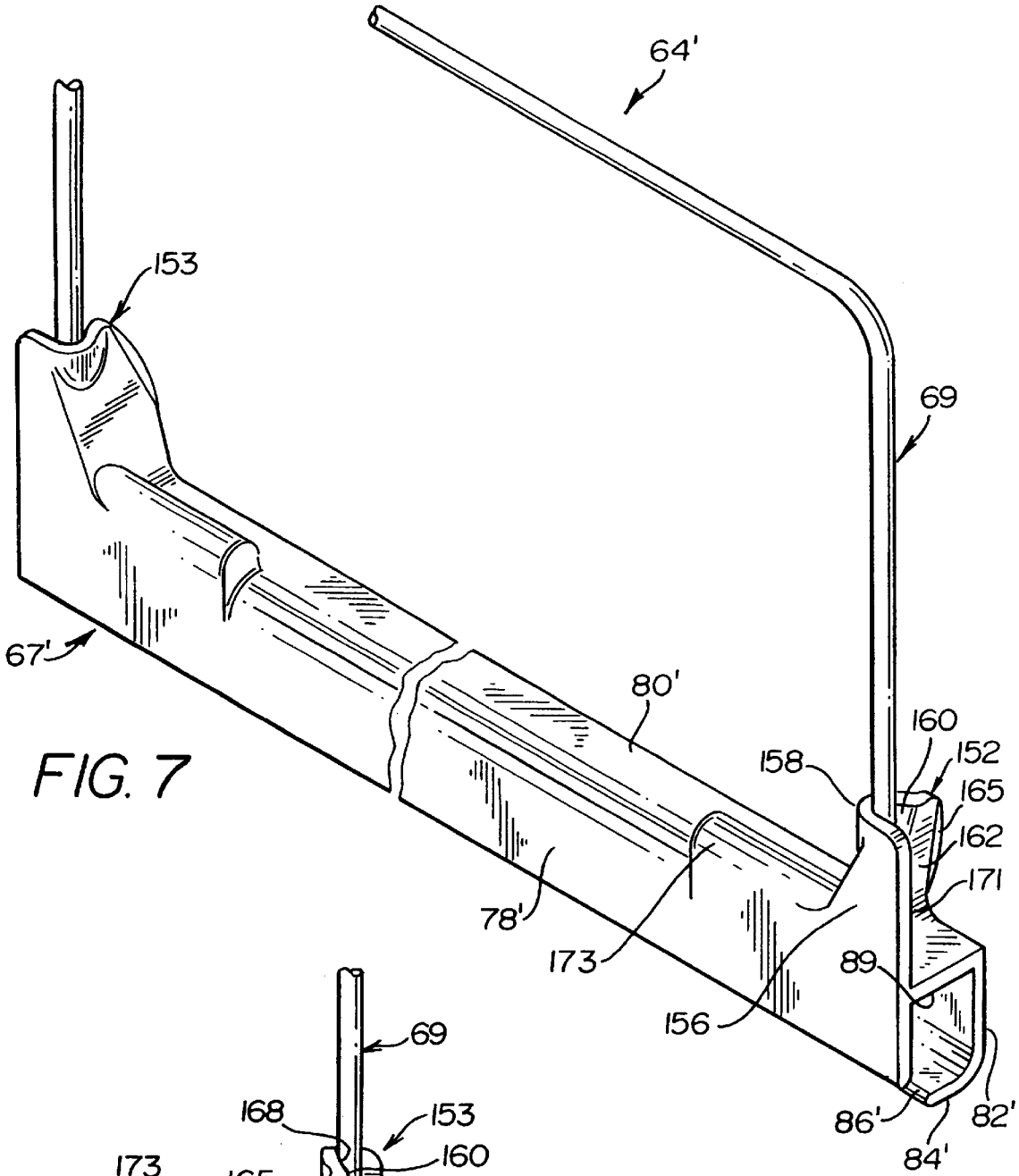
FIG. 7 depicts an adjustable retainer assembly constructed in accordance with a second embodiment of the invention.
Figure 8:
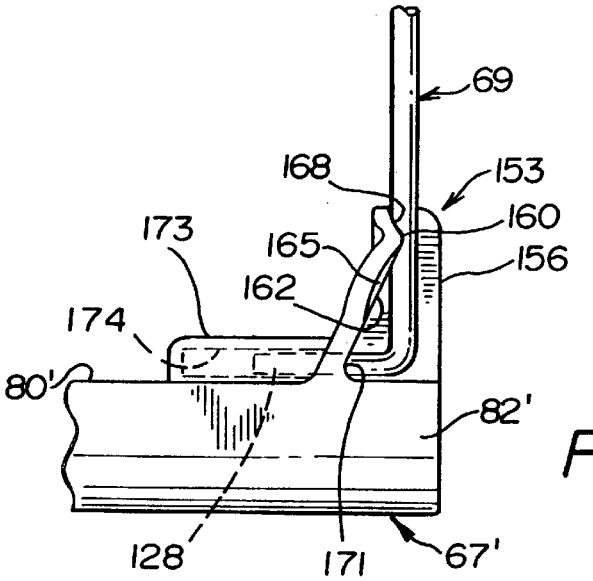
FIG. 8 is an enlarged rear view of one end of the adjustable retainer assembly of FIG. 7.

Reference will now be made to FIGS. 7 and 8 in describing a second preferred embodiment of the retainer assembly of the present invention. In essence, retainer assembly 64' of these figures is essentially identical to that described above with respect to retainer assembly 64, except for the exact construction of mounting sheath 67' and support elements 152 and 153. Due to the analogous structure between these embodiments, only the differences will be detailed here. As shown in these figures, mounting sheath 67' includes legs 78', 80', 82' and 84', with front leg 78' being spaced from lower leg 84' by an elongated opening 86'. The overall shape of mounting sheath 67' is slightly different from that of mounting sheath 67 of the first embodiment described above. In general, it should be readily understood that the particular shape and construction of the mounting sheath used in accordance with the present invention can vary depending upon the actual configuration of the type of shelf rail or the like to which the retainer assembly is attached. Therefore, the embodiment of FIGS. 7 and 8 merely illustrates another preferred configuration of the overall retainer assembly of the present invention. As shown, each support element 152, 153 includes a front upright leg 156 which leads from open end 89 to a curved section 158. Curved section 158 leads to a transition portion 160 which, in turn, leads to a downwardly angled, camming surface portion 162. Camming surface portion 162 is preferably formed with an inwardly tapering section 165 against which retaining element 69 can slide.

With this construction, curved section 158 defines a recess or groove 168. In addition, at the bottom of camming surface 162, i.e., where camming surface 162 meets top leg 80, a radiused section 171 is formed. Radiused section 171 preferably conforms to retaining element 69 and can define a second extreme position for retaining element 69. Furthermore, each support element 152, 153 includes a hollow body portion 173 which defines a bore 174 that opens up into groove 168. In a manner similar to lateral bore 108, the in-turned terminal ends 127 and 128 of retaining element 69 are received in respective bores 174 to permit rotation of retaining element 69. Due to the inclusion of camming surface 162 and tapering section 165, retaining element 69 can assume substantially an infinite number of positions between the first and second extreme positions in a manner directly correspondent to that described above with respect to the first embodiment of the invention. In the most preferred embodiment, both camming surface 162 and tapering section 165 extend downwardly and inwardly at an angle in the range of approximately 23° to 27° and, most preferably 25°. It has been determined that this angle is optimal in not only allowing smooth movement of retainer element 69, but also providing a requisite resistance force against moving retainer element 69 up, i.e., a sufficient retaining force is established against the shelf supported food items.

Figure 9:
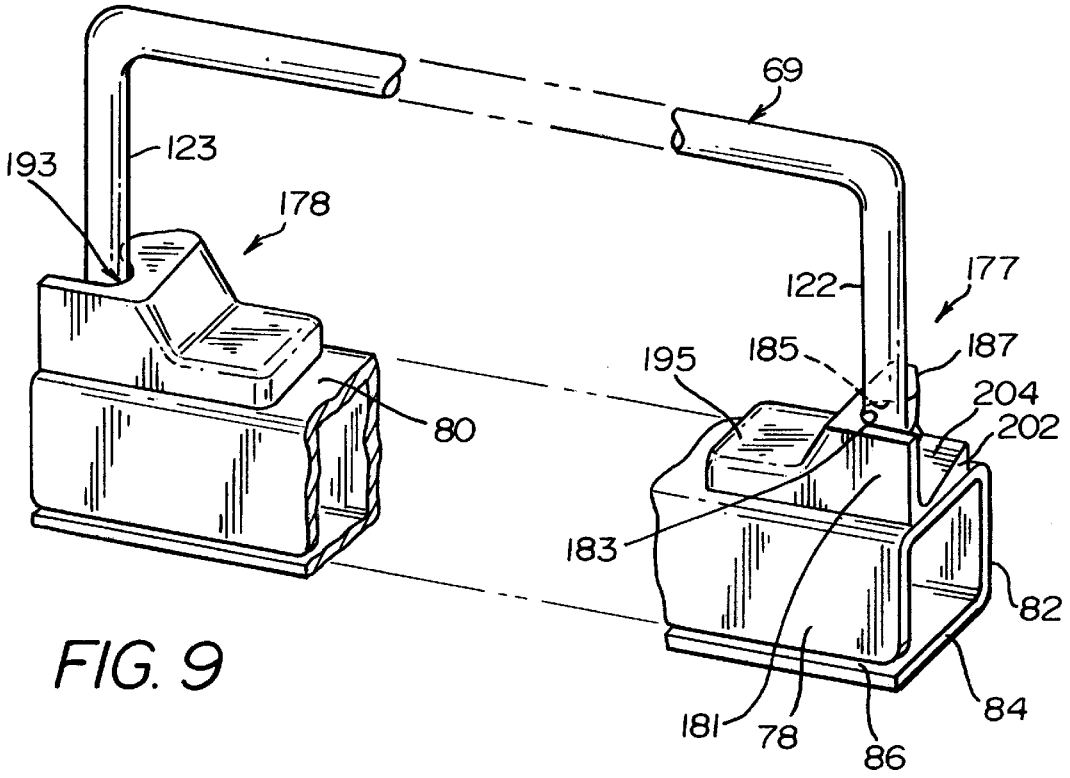
FIG. 9 depicts an adjustable retainer assembly constructed in accordance with a third embodiment of the invention.
Figure 10:
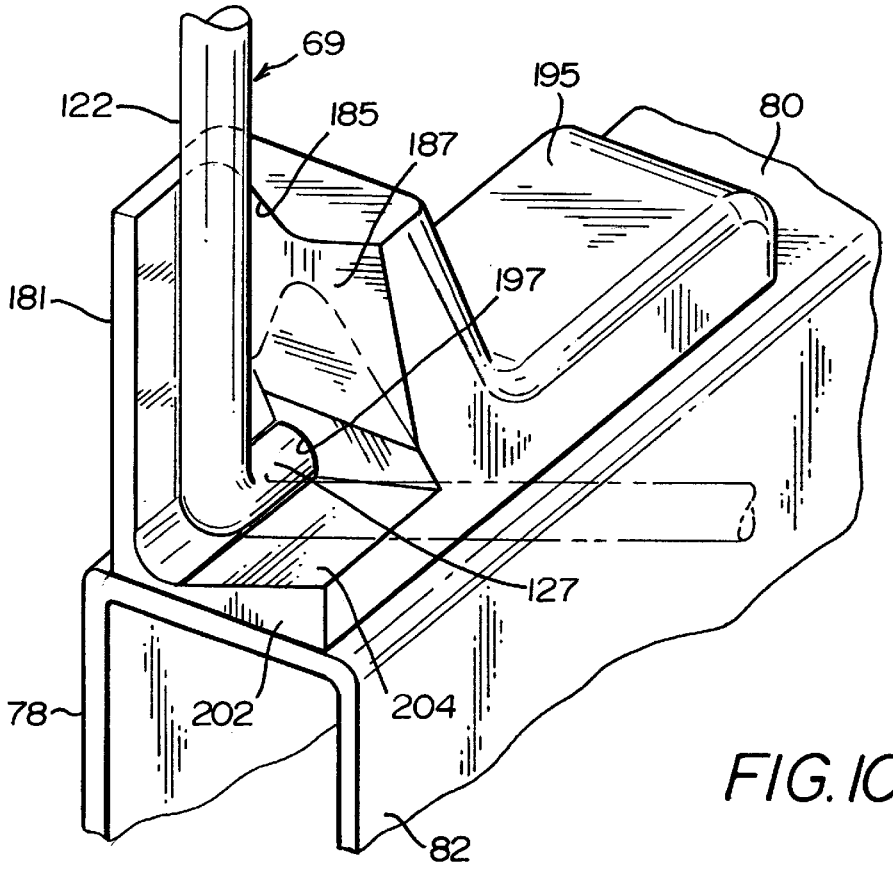
FIG. 10 is an enlarged perspective view of one end of the adjustable retainer assembly of FIG. 9.

FIGS. 9 and 10 illustrate a still further embodiment of the invention. As with the embodiment of FIGS. 7 and 8, this embodiment differs from that described above only with respect to support elements 177 and 178. Here, each support element 177, 178 includes a front upright leg 181 which leads to an inner curved section 183, a transition portion 185 and an angled camming surface portion 187. Curved section 183 defines a recess or groove 193 which functions to hold retaining element 69 in a first, generally upright position. Each support element 177, 178 also includes a body portion 195 that is provided with a bore 197 opening into a respective groove 193 for receiving in-turned terminal ends 127, 128 of retaining element 69. Again, retaining element 69 can be rotated from the position shown in FIG. 9 towards the position shown in dotted lines in FIG. 10 by being physically deformed when riding on transition portion 185 and camming surface 187. Due to the friction between bent sections 122 and 123 and camming surfaces 187, as well as the forces tending to bias bent sections 122 and 123 together, retaining element 69 can be maintained in a substantially infinite number of positions along camming surface 187. This allows retaining element 69 to universally retain containers exhibiting an extremely wide range of different shapes and sizes on fresh food compartment door 7.

Support elements 177 and 178 also differ from those described above with respect to the first two embodiments of the invention in that support elements 177 and 178 include respective bases 202 which include sloped surfaces 204. This aspect of the invention is presented here to illustrate that the extreme positions for retaining element 69 can readily vary in accordance with the present invention. Therefore, front upright leg 181 could be provided with a similar sloped or tapered surface such that the first extreme position of retaining element 69 is other than vertical, with groove 193 being preferably, appropriately angled with respect to the vertical.

Based on the above, it should be realized that retainer assembly 64 constructed in accordance with each of the embodiments set forth herein can be used to advantageously maintain a wide range of containers on shelves 45–50 of fresh food compartment door 7. Although the most preferred embodiment of the invention utilizes a mounting sheath 67 as part of retainer assembly 64 wherein mounting sheath 67 can be separately attached to a respective crosspiece 55–60, it should be noted that the various support elements could be equally integrated as part of the crosspieces 55–60 without departing from the spirit of the invention. In any event, although the invention has been described with respect to preferred embodiments thereof, it should be readily apparent that various changes and/or modifications could be made to the invention without departing from the spirit thereof. Instead, the invention is only intended to be limited by the scope of the following claims.

We claim:

1. In a refrigerator door including an inner liner having an upstanding wall portion with laterally spaced dike portions projecting therefrom and at least one shelf including a base for supporting one or more food items between the dike portions, as well as a crosspiece extending above the base and laterally between the dike portions to aid in preventing the food items from inadvertently falling off the base, an adjustable retainer assembly comprising: a retaining element connected to the crosspiece for pivotal movement relative to the crosspiece between first and second extreme positions, as well as a substantially infinite number of intermediate positions, wherein said retaining element includes a portion which extends across a substantial section of the at least one shelf at a position which, when the retaining element is in the first extreme position and at least a majority of the intermediate positions, is both spaced from and higher than the crosspiece, said portion of the retaining element being adapted to abut a frontal zone of one or more of the food items.

2. The adjustable retainer assembly according to claim 1, wherein, in the first extreme position, the retaining element extends in a substantially vertical plane.

3. The adjustable retainer assembly according to claim 2, wherein, in the first extreme position, the retaining element extends substantially, directly above the crosspiece.

4. The adjustable retainer assembly according to claim 2, wherein, in the second extreme position, the retaining element extends in a substantially horizontal plane.

5. In a refrigerator door including an inner liner having an upstanding wall portion with laterally spaced dike portions projecting therefrom and at least one shelf including a base for supporting one or more food items between the dike portions, as well as a crosspiece extending above the base and laterally between the dike portions to aid in preventing the food items from inadvertently falling off the base, an adjustable retainer assembly comprising:

a retaining element connected to the crosspiece for pivotal movement relative to the crosspiece between first and second extreme positions, as well as a substantially infinite number of intermediate positions; and first and second support elements attached to the crosspiece at laterally spaced positions, said retaining element being pivotally connected to each of the support elements.

6. The adjustable retainer assembly according to claim 5, wherein the retaining element includes opposing terminal ends rotatably supported by the first and second support element respectively.

7. The adjustable retainer assembly according to claim 6, wherein the retaining element is defined by an inverted, generally U-shaped bar.

8. The adjustable retainer assembly according to claim 7, wherein the terminal ends of the retaining element are in-turned.

9. The adjustable retainer assembly according to claim 5, wherein the retaining element is deformed when shifted between the infinite number of intermediate positions.

10. The adjustable retainer assembly according to claim 9, wherein at least one of the first and second support elements is formed with a camming surface against which the retaining element rides when the retaining element is shifted between the infinite number of intermediate positions.

11. The adjustable retainer assembly according to claim 10, wherein the camming surface slopes downwardly and inwardly at an angle of approximately 25° to a vertical.

12. The adjustable retainer assembly according to claim 10, wherein the camming surface is further formed with a tapered section adapted to be slidably engaged by the retaining element.

13. The adjustable retainer assembly according to claim 5, further comprising: a retaining sheath snap-fit onto the crosspiece, said first and second support elements being fixed to the retaining sheath.

14. The retainer assembly according to claim 5, wherein at least one of the first and second support elements includes discreet locating structure for positively maintaining retaining element in a selected one of first and second extreme positions.

15. In a refrigerator door including an inner liner having an upstanding wall portion with laterally spaced dike portions projecting therefrom and at least one shelf including a base for supporting one or more food items between the dike portions, as well as a crosspiece extending above the base and laterally between the dike portions to aid in preventing a food item from inadvertently falling off the base, an adjustable retainer assembly comprising:

a retaining element attached to further aid in preventing food items from inadvertently falling off the base, said retaining element being mounted for pivotal movement relative to the crosspiece; and a camming surface adapted to be engaged by the retaining element, said retaining element being adapted to be repositioned along the camming surface to provide a substantially infinite number of retaining positions between first and second extreme positions, wherein the retaining element is physically deformed when shifted along the camming surface.

16. The adjustable retainer assembly according to claim 15, wherein the camming surface slopes downwardly and inwardly at an angle of approximately 25° to a vertical.

17. The adjustable retainer assembly according to claim 15, wherein the camming surface is further formed with a tapered section adapted to be slidably engaged by the retaining element.

18. The adjustable retainer assembly according to claim 15, wherein, in the first extreme position, the retaining element extends in a substantially vertical plane.

19. The adjustable retainer assembly according to claim 18, wherein, in the second extreme position, the retaining element extends in a substantially horizontal plane.

20. The adjustable retainer assembly according to claim 15, further comprising: first and second support elements attached to the crosspiece at laterally spaced positions, said retaining element being pivotally connected to each of the support elements.

21. The adjustable retainer assembly according to claim 20, wherein the retaining element includes opposing terminal ends rotatably supported by the first and second support element respectively.

22. The adjustable retainer assembly according to claim 21, wherein the retaining element is defined by an inverted, generally U-shaped bar, with the terminal ends being in-turned.

23. The adjustable retainer assembly according to claim 20, further comprising: a retaining sheath snap-fit onto the crosspiece, said first and second support elements being fixed to the retaining sheath.

24. The retainer assembly according to claim 20, wherein at least one of the first and second support elements includes discreet locating structure for positively maintaining retaining element in at least one of the first and second extreme positions.

* * * * *